United States Patent [19]

Rotolico

[11] Patent Number: 4,928,879

[45] Date of Patent: May 29, 1990

[54] WIRE AND POWER THERMAL SPRAY GUN

[75] Inventor: Anthony J. Rotolico, Hauppauge, N.Y.

[73] Assignee: The Perkin-Elmer Corporation, Norwalk, Conn.

[21] Appl. No.: 289,067

[22] Filed: Dec. 22, 1988

[51] Int. Cl.[5] ..... B05B 7/20

[52] U.S. Cl. ..... 239/8; 239/13; 239/80; 239/83; 239/85; 427/34; 427/423; 219/76.16; 219/121.47; 219/121.53

[58] Field of Search ..... 239/8, 13, 79, 80, 81, 239/83, 84, 85; 427/34, 423; 219/121.47, 121.53, 76.16

[56] References Cited

U.S. PATENT DOCUMENTS

| | | | |
|---|---|---|---|
| 2,233,304 | 2/1941 | Bleakley | 239/85 |
| 2,317,173 | 4/1943 | Bleakley | 239/85 |
| 2,361,420 | 10/1944 | Shepard | 239/84 |
| 3,148,818 | 9/1964 | Charlop | 239/84 |
| 3,171,599 | 3/1965 | Rotolico | 239/85 |
| 3,254,970 | 6/1966 | Dittrich et al. | 428/570 |
| 3,312,566 | 4/1967 | Winzeler et al. | 427/34 |
| 3,455,510 | 7/1969 | Rotolico | 239/85 |
| 3,530,892 | 9/1970 | Charlop et al. | 137/625.19 |
| 4,416,421 | 11/1983 | Browning | 239/79 |
| 4,741,974 | 5/1988 | Longo et al. | 428/558 |

FOREIGN PATENT DOCUMENTS 1041056 10/1953 France .

*Primary Examiner*—Andres Kashnikow
*Assistant Examiner*—Karen B. Merritt
*Attorney, Agent, or Firm*—E. T. Grimes; H. S. Ingham

[57] ABSTRACT

A thermal spray gun, for spraying wire and powder simultaneously at high velocity to produce a dense and tenacious coating, comprises a nozzle and a gas cap extending from the nozzle. Combustible gas is injected from the nozzle coaxially into the combustion chamber in the gas cap. An annular outer flow of pressurized air is injected into the chamber adjacent to the gas cap. Heat fusible wire is fed axially from the nozzle into the combustion chamber. An annular inner flow of pressurized air is injected into the combustion chamber adjacent to the wire. Powder in a carrier gas is fed annularly from the nozzle into the combustion chamber coaxially between the combustible mixture and the inner flow, such that a spray stream containing the powder and the heat fusible material commingled in finely divided form is propelled through the open end.

27 Claims, 2 Drawing Sheets

WIRE AND POWER THERMAL SPRAY GUN

This invention relates to thermal spraying and particularly to a method and a gun for combustion thermal spraying wire and powder simultaneously.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A thermal spray gun is used for the purpose of both heating and propelling the particles. In one type of thermal spray gun, such as described in U.S. Pat. Nos. 3,455,510 and 3,171,599 (both Rotolico, now assigned to the present assignee), a low velocity combustion flame is used and the heat fusible material is supplied to the gun in powder form. Such powders are typically comprised of small particles, e.g., between 100 mesh U.S. Standard screen size (149 microns) and about 2 microns. The carrier gas, which entrains and transports the powder, can be one of the combustion gases or an inert gas such as nitrogen, or it can be simply compressed air. Other heating means may be used as well, such as arc plasmas, electric arcs, resistance heaters or induction heaters, and these may be used alone or in combination with other forms of heaters.

The material alternatively may be fed into a heating zone in the form of a rod or wire such as described in U.S. Pat. Nos. 3,148,818 (Charlop) and 2,361,420 (Shepard). In the wire type thermal spray gun, the rod or wire of the material to be sprayed is fed into the heating zone formed by a flame of some type, such as a combustion flame, where it is melted or at least heat-softened and atomized by an atomizing blast gas such as compressed air, and thence propelled in finely divided form onto the surface to be coated.

A newer, rocket type of spray gun is typified in U.S. Pat. No. 4,416,421 (Browning). This type of gun has an internal combustion chamber with a high pressure combustion effluent directed through an annular opening into the constricted throat of a long nozzle chamber. Powder or wire is fed axially within the annular opening into the nozzle chamber to be heated and propelled by the combustion effluent.

Short-nozzle spray devices are disclosed for high velocity combustion spraying in French Patent No. 1,041,056 (Union Carbide Corp.) and U.S. Pat. No. 2,317,173 (Bleakley). Powder is fed axially into a melting chamber within an annular flow of combustion gas. An annular air flow is injected coaxially outside of the combustion gas flow, along the wall of the chamber. The spray stream with the heated powder issues from the open end of the combustion chamber.

These short-nozzle devices have a nozzle construction similar to commercial wire spray guns of the type disclosed in the aforementioned U.S. Pat. No. 3,148,818. However, wire guns function quite differently, the combustion flame melting the wire tip which extends about 0.5 to 1.0 inches from the air cap on the gun, and the air atomizing the molten material from the tip and propelling the droplets. Wire guns generally have been used to spray only at moderate velocity, again despite having been in widespread commercial use for over 50 years.

Thermal spray guns generally are directed to spraying either powder or wire, rather than spraying both simultaneously. An exception is U.S. Pat. No. 3,312,566 (Winzeler et al; FIG. 6 thereof) which discloses a plasma spray gun in which a rod is fed into one side of the plasma jet, and powder is fed into the other side. Those skilled in the art will recognize a tendency for feed material to ride the side of the plasma jet whence the material is fed. Therefore, less than complete commingling of the rod material and powder material may be expected in the spray stream.

Another exception is U.S. Pat. No. 2,233,304 (Bleakley) which discloses an attachment to a combustion wire (rod) gun for introducing powder such as graphite forward and annularly outward of the heating flame and atomizing gas. Although directed to mixing the powder and wire material in the coating, the patent expressly provides for separation of the powder from the adjacent molten particles by the atomizing gas.

Composite wire formed of an alloy sheath and a powder core is described in U.S. Pat. No. 4,741,974 (Longo et al) of the present assignee. Such wire has been quite successful for thermal spraying, but requires special manufacture and does not allow full choice of materials and relative proportions of the sheath alloy and core materials.

Since thermal spraying involves melting or at least surface heat softening the spray material, difficult-to-melt powders such as most carbides, borides and nitrides cannot be fed into the gun without incorporating a binder into the material. Thus a material such as tungsten carbide powder typically has an integral cobalt binder fused or sintered with the carbide. Other powders for thermal spraying are formed by compositing or cladding one material onto a core of another material. Such requirements add to costs and limit versatility of coating compositions. Also, the compositing or cladding has not been fully sufficient for producing the most desirable quality coatings and optimum deposit efficiency with ordinary thermal spray guns.

Therefore objects of the present invention are to provide an improved thermal spray apparatus for simultaneous spraying of wire and powder, to provide a thermal spray gun for wire and powder in which the wire material and the powder have improved commingling in the spray stream, to provide a novel thermal spray gun in which wire and powder are fed independently, to provide thermal spray apparatus and method for producing novel coatings, to provide a method and apparatus for producing dense tenacious thermal sprayed coatings, and to provide a novel method and apparatus for combustion thermal spraying at high velocity.

SUMMARY OF THE INVENTION

The foregoing and other objects are achieved with a thermal spray gun including nozzle means for generating an annular heating flame, wire means for feeding a wire of heat fusible material axially from the nozzle within the heating flame such that the wire is melted at a tip of the wire by the heating flame, and disintegrating means for disintegrating the melted material from the wire tip and propelling the disintegrated material in a spray stream. The gun further comprises powder means for feeding a powder stream coaxially between the wire and the heating flame, thereby commingling the powder and the disintegrated material in the spray stream.

In a preferred embodiment the wire material and powder are sprayed together at high velocity to produce a dense and tenacious coating. A gun comprises a nozzle member with a nozzle face and a gas cap extending from the nozzle member and having an inwardly facing cylindrical wall defining a combustion chamber with an axis, an open end and an opposite end bounded by the nozzle face. Combustible gas means inject an annular flow of a combustible mixture of a combustion gas and oxygen from the nozzle member coaxially into the combustion chamber. Outer gas means inject an annular outer flow of pressurized non-combustible gas adjacent to the cylindrical wall radially outward of the annular flow of the combustible mixture. Wire means feed heat fusible thermal spray wire axially from the nozzle into the combustion chamber to a point where a wire tip is formed. Powder means feed powder in a carrier gas annularly from the nozzle member into the combustion chamber coaxially between the combustible mixture and the wire, such that, with a combusting combustible mixture, a spray stream containing the powder and the heat fusible material commingled in finely divided form is propelled through the open end.

Preferably an inner gas means inject an annular inner flow of pressured gas from the nozzle member into the combustion chamber adjacent to the wire, and intermediate gas means inject an annular intermediate flow of pressurized gas from the nozzle member into the combustion chamber coaxially between the combustible mixture and the powder-carrier gas.

DETAILED DESCRIPTION OF THE INVENTION

Figure 1:
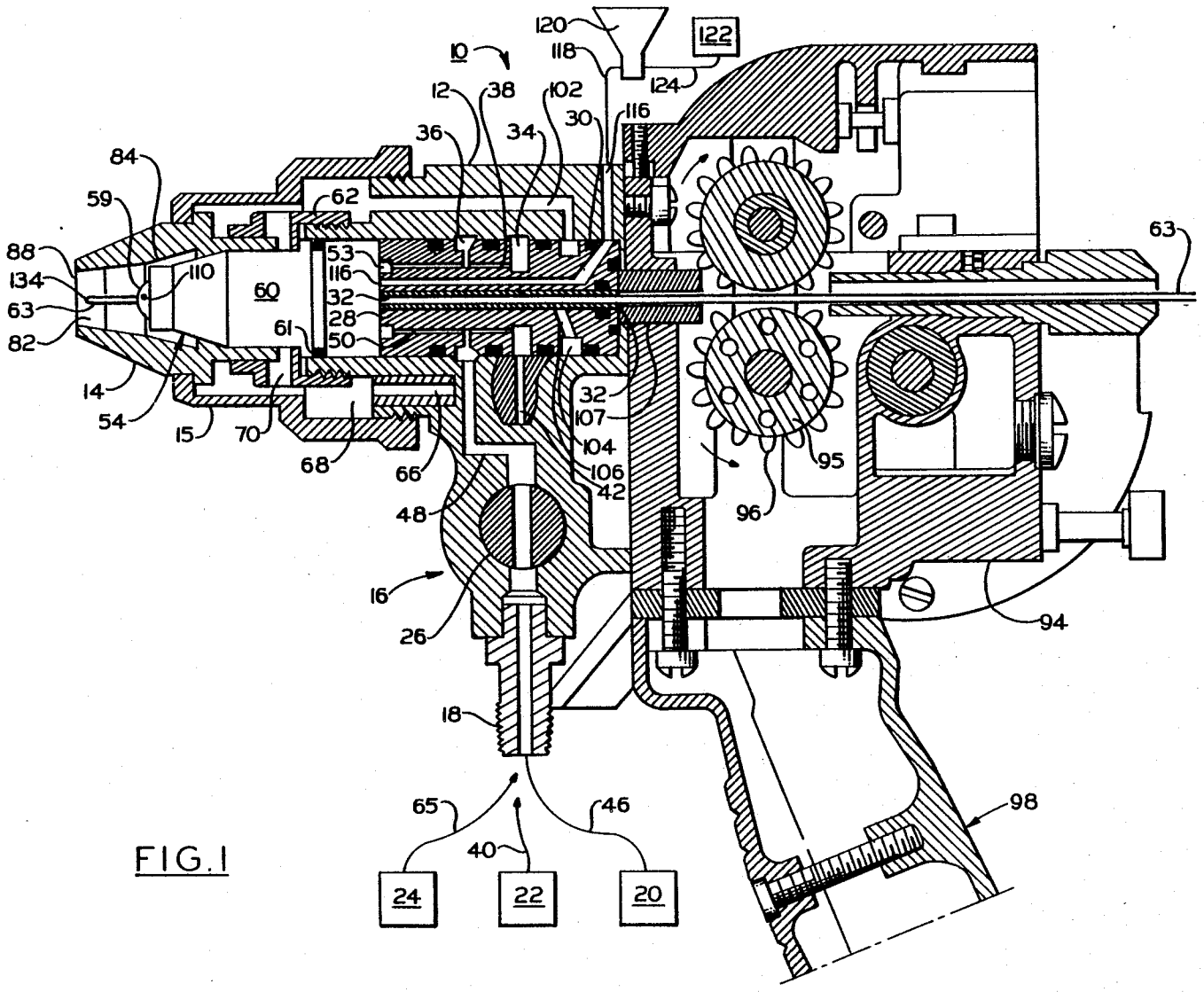
FIG. 1 is an elevation in vertical section of a thermal spray gun used in the present invention.

A thermal spray apparatus incorporating the present invention is illustrated in FIG. 1. A thermal spray gun 10 has a gas head 12 with a gas cap 14 mounted with a retainer ring 15 thereon, and a valve arrangement 16 for fuel, oxygen and air. The valve arrangement has a hose connection 18 for a fuel gas. Two other hose connections (not shown) for oxygen and air are spaced laterally from connector 18, above and below the plane for FIG. 1. The three connections are connected respectively by hoses from a fuel source 20, oxygen source 22 and air source 24. A cylindrical valve 26 controls the flow of the respective gases from their connections into the gun.

A cylindrical siphon plug 28 is fitted in a corresponding bore in the gas head, and a plurality of O-rings 30 thereon maintain gas-tight seals. The siphon plug is provided with a central passage 32, and with an annular groove 34 and a further annular groove 36 with a plurality of inter-connecting passages 38 (two shown). With cylinder valve 26 in the open position as shown in FIG. 1, oxygen is passed by means of a hose 40 through its connection (not shown) and valve 26 into a passage 42 (partially shown) from whence it flows into groove 34 and through passage 38.

Figure 2:
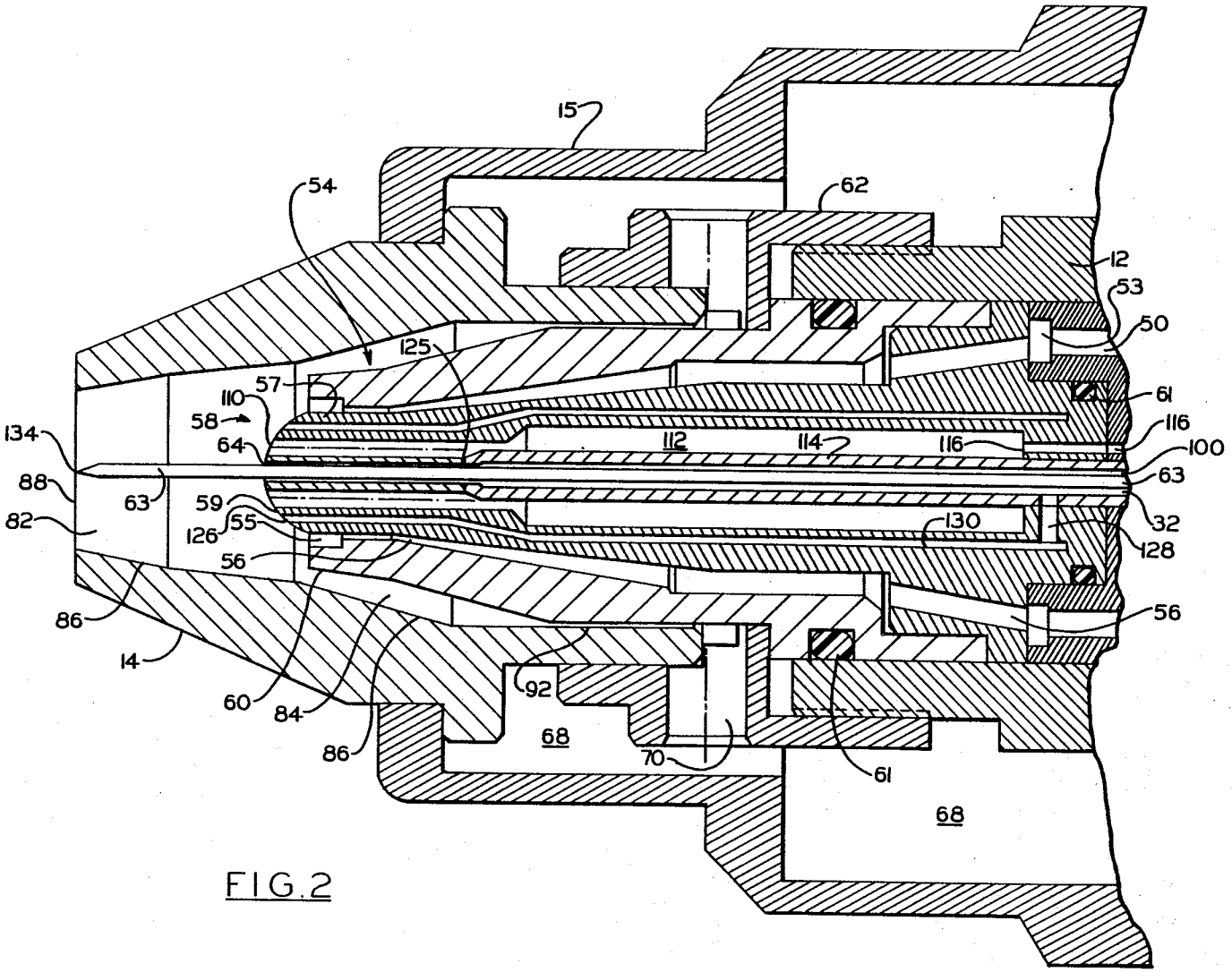
FIG. 2 is a cross-sectional detail of the forward end of the gun of FIG. 1.

A substantially identical arrangement is provided to pass fuel gas from source 20 and a hose 46 through connection 18, valve 26 and a passage 48 into groove 36, mix with the oxygen, and pass as a combustible mixture through passages 50 aligned with passages 38 into an annular groove 53. With reference also to FIG. 2, annular groove 53 is adjacent the rear surface of a nozzle member 54 which is provided with an annular opening 55 at face 58 at the forward end of the nozzle, fed by an annular channel 56 from groove 53. Opening 55 exits at a circular location on face 58 coaxial with gas cap 14. The combustible mixture from groove 53 passes through channel 56 to produce an annular flow and is ignited at face 58 of nozzle 54.

Nozzle member 54 is conveniently constructed of a tubular inner portion 59 and a tubular outer portion 60. (As used herein and in the claims, "inner" denotes toward the axis and "outer" denotes away from the axis. Also "forward" or "forwardly" denotes toward the open end of the gun; "rear", "rearward" or "rearwardly" denotes the opposite.) Inner and outer portions 59,60 cooperatively define an outer annular orifice means for injecting the annular flow of the combustible mixture into the combustion chamber. The orifice means preferably includes forward annular opening 55 with a radially inward side bounded by an outer wall 57 of face 58 of the inner portion. The channel system 56 leading to annular opening 55 from groove 53 may be a plurality of arcuately spaced orifices, but preferably is an annular orifice.

A nozzle nut 62 holds nozzle 54 and siphon plug 28 on gas head 12. Further O-rings 61 are seated conventionally between nozzle 54 and siphon plug 28 for gas tight seals. Burner nozzle 54 extends into gas cap 14 which is held in place by means of retainer ring 15 and extends forwardly from the nozzle. Nozzle member 54 is also provided with an axial bore 64 extending forwardly as a continuation of passage 32, for a spray wire 63 which is fed from the rear of gun 10 (FIG. 1).

Air or other non-combustible gas is passed from source 24 (FIG. 1) and hose 65 through its connection (not shown), cylinder valve 26, and a passage 66 (partially shown) to a space 68 in the interior of retainer ring 15. Lateral openings 70 in nozzle nut 62 communicate space 68 with a cylindrical combustion chamber 82 in gas cap 14 so that the air may flow as an outer sheath from space 68 through these lateral openings 70, thence through an annular slot 84 between the outer surface of nozzle 54 and an inwardly facing cylindrical wall 86 defining combustion chamber 82, through chamber 82 as an annular outer flow, and out of the open end 88 in gas cap 14. Chamber 82 is bounded at its opposite, inner end by face 58 of nozzle 54.

A rear body 94 contains drive mechanism for wire 63. A conventional electric motor or air turbine (not shown) drives a pair of rollers 95 which have a geared connector mechanism 96 and engage the wire. A handle 98 or machine mounting device may be attached to the rear body.

An annular space 100 (FIG. 2) between wire 63 and the outer wall of central passage 32, which also extend through nozzle 54, provides for an annular inner sheath flow of gas, preferably air, about the wire extending from the nozzle. This inner sheath of air prevents backflow of hot gas along the wire and contributes significantly to reducing any tendency of buildup of spray material on wall 86 in the aircap. The sheath air is conveniently tapped from the air supplied to space 68, via a duct 102 (FIG. 1) in gas head 12 to an annular groove 104 in the rear portion of siphon plug 28, and at least one orifice 106 into annular space 100 (FIG. 2) between wire 63 and siphon plug 28. Preferably at least three such orifices 106 (one shown) are equally spaced arcuately to provide sufficient air and to minimize vortex flow which could detrimentally swirl spray material outwardly to wall 86 of chamber 82. A bushing 107 rearward of the siphon plug closely surrounds the wire to minimize back leakage of air. The inner sheath air flow preferably should be between about 10% and 20% of the outer sheath flow rate, for example about 15%. The inner sheath may alternatively be regulated independently of the outer sheath air, for better control.

Preferably combustion chamber 82 converges forwardly from the nozzle at an angle with the axis, most preferably between about 2° and 10°, e.g. 5°. Slot 84 also converges forwardly at an angle with the axis, most preferably between about 12° and 16°, e.g. 14.5° measured at wall 86. Slot 84 further should have sufficient length for the annular air flow to develop, e.g. comparable to the length of the chamber from face 58 to end 88. In addition, the inner part of the chamber should converge at a lesser angle than the slot, most preferably between about 8° and 12°, e.g. 10° less. This configuration provides a converging air flow with respect to the chamber to minimize powder buildup on the chamber wall.

The air flow rate should be controlled upstream of slot 84 such as in a rearward narrow orifice 92 or with a separate flow regulator. For example slot 84 length is 8 mm, slot width (at its exit) is 0.38 mm on a 1.5 cm circle, and air pressure to the gun (source 24) is 4.9 kg/cm$^2$ (70 psi) to produce a total air flow of 425 1/min (900 scfh) with a pressure of 4.2 kg/cm$^2$ (60 psi) in chamber 82. Also, with valve 26 in a lighting position aligning bleeder holes as described in aforementioned U.S. Pat. No. 3,530,892, an air hole (not shown) in valve 26 allows air flow for lighting, and the above-indicated angles and dimensions are important to allow such lighting without backfire. (Bleeder holes in valve 26 for oxygen and fuel for lighting, similar to the air hole, are not shown.)

According to the present invention, nozzle 54 is further provided with an annular ring of powder injection orifices 110 or, alternatively, an annulus. As indicated in FIG. 2 the orifices may be drilled in inner portion 59 to an annular opening 112 between a tubular wire guide 114 disposed in central passage 32. thus annular space 100 is actually formed between wire 63 and guide 114 within siphon plug 28 and nozzle 54. A powder duct 116 leads rearward from opening 112 through inner portion 59, siphon plug 28 and gas head 12, (FIG. 1) where it connects to a powder hose 118 leading from a powder feeder 120 fed with pressurized carrier gas from a gas source 122 via a gas hose 124. As an example, 10 orifices of 0.8 mm diameter lie on a 5.6 mm bolt circle. The forward end 125 of wire guide 114 is brazed to inner portion 59 and, similarly, the rear of inner portion 59 is brazed to the guide.

In a preferred embodiment, the inner portion 55 of nozzle member 54 has further therein a plurality of parallel intermediate orifices 126 (e.g. 8 orifices 0.89 mm diameter) on a bolt circle (e.g. 2.57 mm diameter) which provide for an annular intermediate sheath flow of gas, preferably air, between flame opening 55 and powder orifices 110. This inner sheath of air contributes further to reducing any tendency of buildup of powder material on wall 86. The sheath air is conveniently tapped from passage 100, via a transverse duct 128 (FIG. 2) to an annular groove 130 in gas communication with orifices 126. Preferably at least three such orifices 126 are equally spaced arcuately to provide sufficient air and to minimize vortex flow which could detrimentally swirl the powder outwardly to wall 86 of chamber 82. The intermediate sheath air flow as regulated by orifice size should be between 1% and 10%, preferably about 2% and 5% of the outer sheath flow rate, for example about 3%. The intermediate sheath may alternatively be regulated independently of the outer sheath air, for better control.

According to a further embodiment, it was discovered that chances of powder buildup are even further minimized by having the inner portion 59 of the nozzle member protrude into chamber 82 forwardly of the outer portion 60 as depicted in FIGS. 1 and 2. A chamber length may be defined as the shortest distance from nozzle face 58 to open end 88, i.e. from the forwardmost point on the nozzle to the open end. Preferably the forwardmost point on the inner portion protrudes forwardly from the outer portion 60 by a distance between about 10% and 40% of the chamber length, e.g 30%.

A preferred configuration for the inner portion is depicted in the Figures. Referring to the outer wall 57 of inner portion 59 of the nozzle, which partially defines annular opening 55, such wall 57 should extend forwardly from the annular opening with a curvature inward toward the axis. Preferably the curvature is uniform. For example, as shown, the curvature is such as to define a generally hemispherical face 58 on inner portion 59. It is believed that the combustion flame is thereby drawn inwardly to maintain the flows, particularly powder, away from chamber wall 86.

As an example of a thermal spray gun incorporating the present invention, a Metco Type 12E wire gun sold by The Perkin-Elmer Corporation, Westbury, N.Y. is modified as described herein, and is used with an EC air cap, or alternatively a J air cap, and a nozzle 54 as described herein. A No. 5 siphon plug is modified by opening oxygen passage 38 to 1.5 mm to allow increased oxygen flow, and the air orifices 106 are opened to 1.0 mm to provide increased inner air flow. The siphon plug is further modified to receive tube guide 114 and include power duct 116 and add O-rings. In this gas head the annular air slot 84 between nozzle 60 and gas cap 14 is 0.5 mm wide at its entrance to chamber 82, and tube 114 has a 3.3 mm inside diameter for 3.175 mm wire. The open end 88 of the gas cap is 6.4 mm from the nearest face of the nozzle. Thus the combustion chamber 82 is relatively short, and generally should be between about one and two times the diameter of open end 88. The size (diameter) of the spray stream and the deposit pattern on the substrate may be selected by selection of the diameter of open end 88.

According to a preferred embodiment, a supply of each of the gases to the cylindrical combustion chamber is provided at a sufficiently high pressure in the chamber, e.g. at least 3 atmospheres above ambient atmosphere, and is ignited conventionally such as with a spark device, such that the mixture of combusted gases and air will issue from the open end as a supersonic flow entraining the powder. The heat of the combustion will melt the wire tip and the pressure and velocity of the gases including the outer sheath air atomize the molten metal and propel the same at high velocity such as to deposit a coating onto a substrate. Shock diamonds should be observable particularly without wire feeding in the gun. Because of the annular flow configuration, an expansion type of nozzle exit is not necessary to achieve the supersonic flow.

The wire speed should be adjusted so that wire tip 134 being melted is located proximate open end 88, as distinct from being beyond the air cap by a distance about equal to the diameter of the opening in a conventional wire gun operation. Generally tip 134 should be within about 25% of the opening diameter from the plane of open end 88.

Further according to the present invention, the oxygen and combustion gas flows are relatively high in proportion to the flow rate of the outer sheath of air flow through slot 84, compared to a conventional wire gun. The reason is that, in the present invention, the role of atomization, i.e. disintegration of the melting wire tip, is partially taken over by the high velocity, supersonic flow of combustion products through open end 88.

Using oxygen flow as a measure of the flow of combustion products, the flow rate of oxygen should be at least about 80% of the outer sheath air flow and preferably between 90% and 100%. For example an oxygen flow rate of 340 l/m and an outer air flow of 357 l/m corresponds to the oxygen being 95% of the air, and compares with a conventional wire gun being operated conventionally with MPS gas and oxygen at 83 l/m and 623 l/m air, i.e., 14%, oxygen compared to air. The passages for oxygen should be of such cross sectional area and length as to allow the appropriate flow, in mixture with the combustion gas, into the combustion chamber at least three atmospheres. The outer air sheath should similarly be such as to allow the proper flow relative to oxygen; a conventional wire gun air flow is suitable. The combustion gas is generally close to stoichiometric relative to the oxygen, and may be propane, hydrogen or the like.

Two preferable combustion gases for the present invention are propylene gas and methylacetylene-propadiene gas ("MPS"). Each of these gases allows a relatively high velocity spray stream and excellent coatings to be achieved without backfire. The mixture in the chamber should be at a pressure of at least two atmospheres above ambient atmosphere to assure supersonic spray. For example with a propylene or MPS pressure of about 7 kg/cm$^2$ (100 psig) gauge (above atmospheric pressure) to the gun, oxygen at 10.5 kg/cm$^2$ (150 psig) and air at 5.6 kg/cm$^2$ (80 psig), at least 8 shock diamonds are readily visible in the spray stream without powder flow or wire feed.

The wire or rod should have conventional sizes and accuracy tolerances for thermal spray wires and thus, for example may vary in size between 6.4 mm and 0.8 mm (20 gauge). The wire or rod may be formed conventionally as by drawing, or may be formed by sintering together a powder, or by bonding together the powder by means of an organic binder or other suitable binder which disintegrates in the heat of the heating zone, thereby releasing the powder to be sprayed in finely divided form. Any conventional or desired thermal spray wire of heat fusible material may be utilized, generally metal, but also ceramic rod may be utilized.

The powder may be any conventional or desired, heat fusible material of conventional size, generally between 100 and 5 microns such as −75+45 microns or −45+10 microns. Examples are the self fluxing alloys or oxides such as alumina, zirconia and chromia, or nickel-aluminum composites. However, a feature of the present invention is the ability to include non-meltable (at atmospheric pressure) or difficult-to-melt powders, even diamond powder. Thus carbides, borides and nitrides of tungsten, titanium, chromium, zirconium, tantalum and the like, with or without metal binder, may be fed in powder form. For example, silicon carbide powder of size −20+5 microns may be fed at a rate of 1.5 kg/hr simultaneously with nickel −20 chromium alloy wire at 4 kg/hr to effect a nickel chromium bonded silicon carbide coating.

Another example is boron carbide powder sized −15+5 microns fed at 2 kg/hr simultaneously with aluminum wire at 6 kg/hr to effect a boron carbide in aluminum coating. Substrate materials and surface preparation are conventional, such as grit blasted steel. Yet another example is silicon nitride powder sprayed with aluminum oxide rod as the wire, to form alumina bonded nitride coatings. Boron nitride powder may be fed with nickel-chromium alloy wire. Pre-thermoset polymer powders such as high temperature poly(-paraoxylbenzoyl)ester may be fed with a binder metal wire such as silicon-aluminum or aluminum bronze.

Spray velocity is optional over a range. Thus the velocity may be similar to that of the conventional combustion wire spraying process, using standard gas pressure and flow rates. However, as disclosed above, higher supersonic velocity such as may be achieved with the detailed embodiment of apparatus and method described herein is preferred. Dense coating structures with fine oxide dispersion and uniform distribution of the powder material in the wire alloy matrix are effected particularly with high velocity.

In general, the present high velocity combustion process indicates the following benefits: high integrity coatings approaching wrought structures; potential for developing oxide dispersion strengthened structures; ability to apply thick coatings which are amenable to all metal working processes, e.g., milling, drilling, tapping; potential to apply thick coatings which can be used to develop free standing structures; potential to apply coatings of reactive metals, e.g., titanium, magnesium, in absence of any vacuum technologies and potential to apply amorphous structures depending upon available wire chemistries. Coating quality combining low oxide content, high bond strength, low density and high tenaciousness surpass state-of-the-art plasma coatings and detonation gun coatings. Inclusion of powder greatly extends variety of coating composition with additives to such wire coatings. Particularly advantageous are hard particles such as carbides for wear resistance, abrasive grains such as diamonds and silicon carbide for abrasive or cutting type coatings, and lubricant materials such as polymers, molybdenum disulphide and boron nitride. It may be desirable to clad difficult-to-melt powder particles with a metal to enhance sprayability, such as disclosed in U.S. Pat. No. 3,254,970 (Shepard et al).

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A thermal spray gun comprising:

nozzle means for generating an annular heating flame;

wire means for feeding a wire of heat fusible material axially from the nozzle within the heating flame such that the wire is melted at a tip of the wire by the heating flame;

disintegrating means for disintegrating the melted material from the wire tip and propelling the disintegrated material in a spray stream;

powder means for feeding a powder stream coaxially between the wire and the heating flame, thereby commingling the powder and the disintegrated material in the spray stream.

2. A thermal spray gun according to claim 1 further comprising a gas cap extending forwardly from the nozzle means, and the disintegrating means comprises outer gas means for injecting an annular outer flow of pressurized non-combustible gas radially outwardly of the annular heating flame.

3. A thermal spray gun according to claim 2 further comprising inner gas means for injecting an annular inner flow of pressurized gas from the nozzle means adjacent to the wire.

4. A thermal spray gun according to claim 2 further comprising intermediate gas means for injecting an annular intermediate flow of pressurized gas from the nozzle means coaxially between the heating flame and the powder stream.

5. A thermal spray gun according to claim 2 wherein the heating flame is generated by combusting a mixture of a combustion gas and oxygen.

6. A thermal spray gun for spraying at high velocity to produce a dense and tenacious coating, comprising a nozzle member with a nozzle face, a gas cap extending from the nozzle member and having an inwardly facing cylindrical wall defining a combustion chamber with an axis, an open end and an opposite end bounded by the nozzle face, combustible gas means for injecting an annular flow of a combustible mixture of a combustion gas and oxygen from the nozzle member coaxially into the combustion chamber, outer gas means for injecting an annular outer flow of pressurized noncombustible gas adjacent to the cylindrical wall radially outward of the annular flow of the combustible mixture, wire means for feeding thermal spray wire of heat fusable material axially from the nozzle into the combustion chamber to a point where a wire tip is formed, powder means for feeding powder in a carrier gas annularly from the nozzle member into the combustion chamber coaxially between the combustible mixture and the wire such that, with a combusting combustible mixture, material is melted and disintegrated from the wire tip and a spray stream containing the powder and the heat fusible material commingle in finely divided form is propelled through the open end.

7. A thermal spray gun according to claim 6 further comprising inner gas means for injecting an annular inner flow of pressurized gas from the nozzle member into the combustion chamber adjacent to the wire.

8. A thermal spray gun according to claim 6 further comprising intermediate gas means for injecting an annular intermediate flow of pressurized gas from the nozzle member into the combustion chamber coaxially between the combustible mixture and the powder-carrier gas.

9. A thermal spray gun according to claim 6 wherein the nozzle member comprises a tubular outer portion defining an outer annular orifice means for injecting the annular flow of the combustion mixture into the combustion chamber, and a tubular inner portion having therein an annular inner gas orifice means adjacent the wire for injecting the annular inner flow into the combustion chamber and powder orifice means for feeding the powder-carrier gas into the combustion chamber, and wherein the inner portion protrudes into the combustion chamber forwardly of the outer portion.

10. A thermal spray gun according to claim 9 wherein a chamber length is defined by a shortest distance from the nozzle face to the open end, and the inner portion protrudes by a distance between about 10% and 40% of the chamber length.

11. A thermal spray gun according to claim 9 wherein the outer annular orifice means includes an annular opening into the combustion chamber with a radially inward side bounded by an outer wall of the inner portion, the outer wall extending forwardly from the annular opening with a curvature toward the axis.

12. A thermal spray gun according to claim 11 wherein the curvature is such as to define a generally hemispherical nozzle face on the inner portion.

13. A thermal spray gun according to claim 9 wherein the outer gas means includes the nozzle member and a rearward portion of the cylindrical wall defining a forwardly converging slot therebetween exiting into the combustion chamber.

14. A thermal spray gun according to claim 13 wherein the combustion chamber converges forwardly from the nozzle member at an angle with the axis less than a corresponding angle of the converging annular slot.

15. A thermal spray gun according to claim 6 wherein the combustible gas means is disposed so as to inject the combustible mixture into the combustion chamber from a circular location on the nozzle face, the circular location having a diameter approximately equal to the diameter of the open end.

16. A thermal spray gun according to claim 15 wherein the open end is spaced axially from the nozzle face by a shortest distance of between approximately one and two times the diameter of the circular location.

17. A thermal spray gun according to claim 6 wherein the combustible mixture is injected into the combustion chamber at a pressure therein of at least two atmospheres above ambient atmospheric pressure, such that the spray stream is supersonic.

18. A thermal spray gun according to claim 17 wherein the point where the wire tip is formed is proximate the open end of the combustion chamber.

19. A method of producing a dense and tenacious coating with a thermal spray gun including a nozzle member with a nozzle face and a gas cap extending from the nozzle member, the gas cap having an inwardly facing cylindrical wall defining a combustion chamber with an open end and an opposite end bounded by the nozzle face, the method comprising injecting an annular flow of a combustible mixture of a combustion gas and oxygen from the nozzle coaxially into the combustion chamber at a pressure of at least two atmospheres above ambient atmospheric pressure, injecting an annular outer flow of pressurized non-combustible gas adjacent to the cylindrical wall, combusting the combustible mixture, feeding heat fusible thermal spray wire axially from the nozzle into the combustion chamber to a point where a wire tip is formed where material is melted and disintegrated such that a supersonic spray stream containing the heat fusible material in finely divided form is propelled from the wire tip, feeding powder in a carrier gas coaxially from the nozzle into the combustion chamber, between the wire and the combustible mixture, and directing the spray stream toward a substrate such as to produce a coating thereon.

20. A method according to claim 19 further comprising injecting an annular inner flow of pressurized gas from the nozzle into the combustion chamber adjacent to the wire.

21. A method according to claim 19 further comprising injecting an annular intermediate flow of pressurized gas from the nozzle member into the combustion chamber coaxially between the combustible mixture and the powder-carrier gas.

22. A method according to claim 19 wherein the combustible mixture is injected at a sufficient pressure into the cylindrical chamber to produce at least 8 visible shock diamonds in the spray stream in the absence of thermal spray wire and powder-carrier gas in the combustion chamber.

23. A method according to claim 19 further comprising selecting the combustion gas from the group consisting of propylene gas and methylacetylene-propadiene gas.

24. A method according to claim 19 further comprising providing oxygen to the combustible mixture at a flow rate of at least about 80% of the annular outer flow.

25. A method according to claim 19 wherein the combustible mixture is injected through an annular orifice into the combustion chamber.

26. A method according to claim 19 wherein the powder is selected from the group consisting of carbides, borides and nitrides of at least one metal, and diamond.

27. A method according to claim 26 wherein the powder is nonfusible at atmospheric pressure.

* * * * *